US005183256A

United States Patent [19]

Hale

[11] Patent Number: 5,183,256

[45] Date of Patent: Feb. 2, 1993

[54] GAME APPARATUS

[76] Inventor: Calvin L. Hale, Rte. 1, Box 273C, Macomb, Okla. 74852

[21] Appl. No.: 874,506

[22] Filed: Apr. 27, 1992

[51] Int. Cl.[5] ..... A63F 3/00

[52] U.S. Cl. ..... 273/241; 273/271

[58] Field of Search ..... 273/241, 271, 282, 290

[56] References Cited

U.S. PATENT DOCUMENTS

| | | | |
|---|---|---|---|
| 2,075,619 | 3/1937 | Klemin | 273/241 |
| 2,873,975 | 2/1959 | Haws | 273/241 |
| 3,556,526 | 1/1971 | Currie | 273/271 X |
| 3,561,774 | 2/1971 | Brinser | 273/271 X |
| 3,592,472 | 7/1971 | Kent | 273/241 |
| 3,695,614 | 10/1972 | Brisson | 273/241 |
| 4,119,320 | 10/1978 | Chorba et al. | 273/271 X |
| 4,371,170 | 2/1983 | Acevedo | 273/271 |
| 4,522,408 | 6/1985 | McKee | 273/271 |
| 5,116,061 | 5/1992 | Zenter, Jr. | 273/271 X |

FOREIGN PATENT DOCUMENTS

| | | | |
|---|---|---|---|
| 1118002 | 2/1982 | Canada | 273/241 |
| 2905355 | 8/1980 | Fed. Rep. of Germany | 273/271 |
| 3536039 | 4/1987 | Fed. Rep. of Germany | 273/241 |
| 2114010 | 8/1983 | United Kingdom | 273/241 |
| 2226767 | 7/1990 | United Kingdom | 273/241 |

*Primary Examiner*—V. Millin
*Assistant Examiner*—William E. Stoll
*Attorney, Agent, or Firm*—Leon Gilden

[57] ABSTRACT

A game apparatus is provided having a game board, including a plurality of rows of peg members, with each peg member of each row arranged to accommodate a plurality of torroidal members thereon in a sliding relationship. A plurality of dice members are provided, with each player sequentially throwing the dice, with the number of pairs achieved by a roll of the dice directing play and quantity and orientation of the various beads to be mounted on the pegs.

4 Claims, 4 Drawing Sheets

GAME APPARATUS

BACKGROUND OF THE INVENTION

1. Field of the Invention

The field of invention relates to game apparatus, and more particularly pertains to a new and improved game apparatus directed to the entertainment and amusement of individuals directing assembly of pegs and beads together.

2. Description of the Prior Art

Games of various types to amuse and entertain individuals are available in the prior art and exemplified in the U.S. Pat. No. 4,813,678 to Colazzo having a board game to include dice to direct play.

U.S. Pat. No. 3,693,976 to Flack illustrates a prior art peg board game structure.

U.S. Pat. No. 4,522,408 to McKee sets forth a peg board game apparatus of various type for the entertainment and amusement of individuals.

Accordingly, it may be appreciated that there continues to be a need for a new and improved game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides a game apparatus wherein the same directs association of beads and pegs together utilizing dice members as directives. As such, the general purpose of the present invention, which will be described subsequently in greater detail, is to provide a new and improved game apparatus which has all the advantages of the prior art game apparatus and none of the disadvantages.

To attain this, the present invention includes a game apparatus having a game board, including a plurality of rows of peg members, with each peg member of each row arranged to accommodate a plurality of torroidal members thereon in a sliding relationship. A plurality of dice members are provided, with each player sequentially throwing the dice, with the number of pairs achieved by a roll of the dice directing play and quantity and orientation of the various beads to be mounted on the pegs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game apparatus which has all the advantages of the prior art game apparatus and none of the disadvantages.

It is another object of the present invention to provide a new and improved game apparatus which may be easily and efficiently manufactured and marketed.

It is a further object of the present invention to provide a new and improved game apparatus which is of a durable and reliable construction.

An even further object of the present invention is to provide a new and improved game apparatus which is susceptible of a low cost of manufacture with regard to both materials and labor, and which accordingly is then susceptible of low prices of sale to the consuming public, thereby making such game apparatus economically available to the buying public.

Still yet another object of the present invention is to provide a new and improved game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
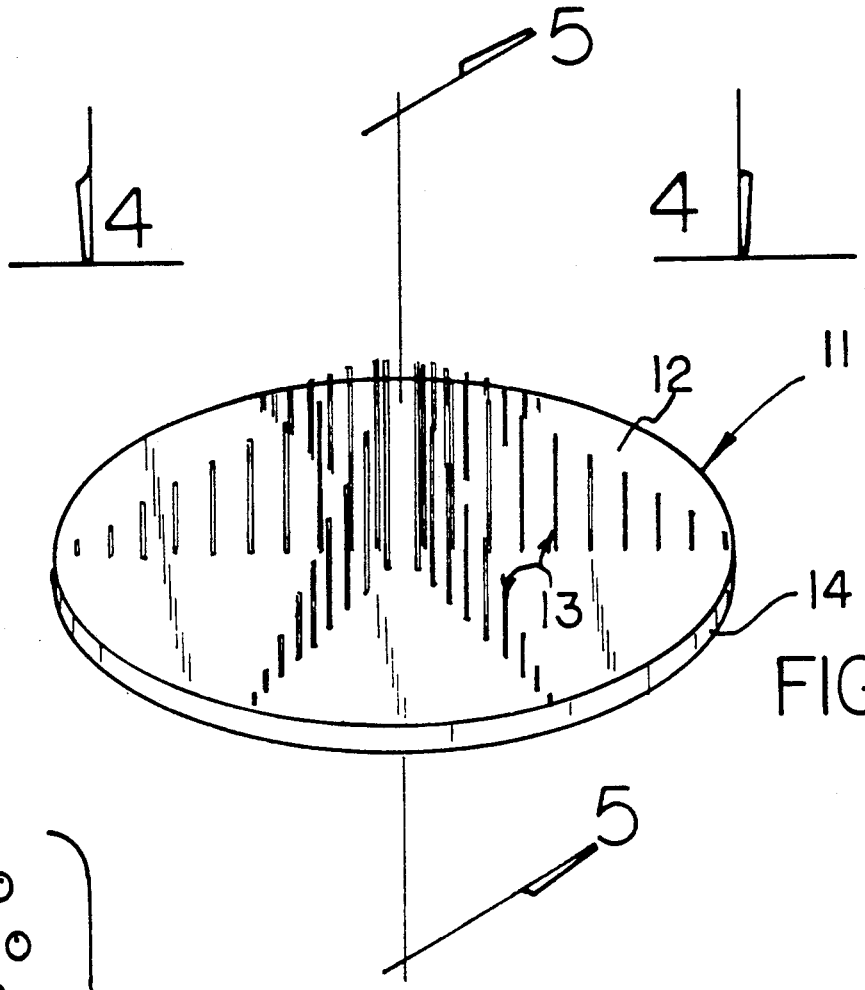
FIG. 1 is an isometric illustration of the game structure.
Figure 2:
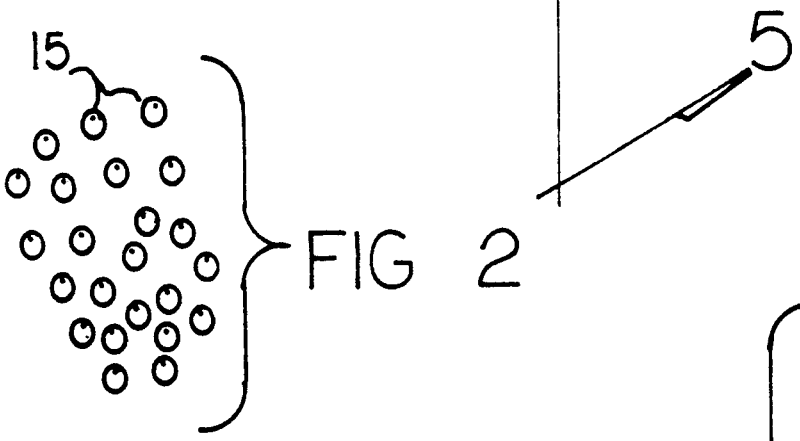
FIG. 2 is an orthographic view of a quantity of beads afforded each player.
Figure 3:
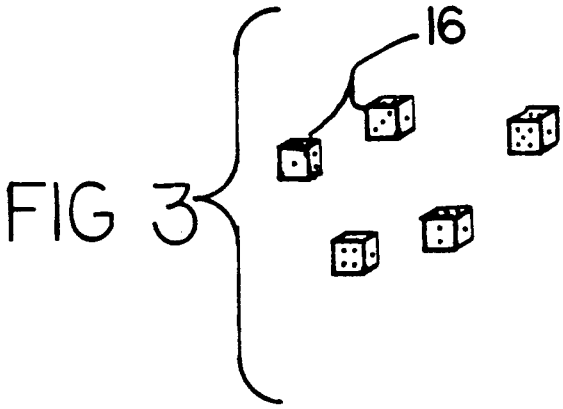
FIG. 3 is an isometric illustration of the five dice members utilized by the invention.
Figure 4:
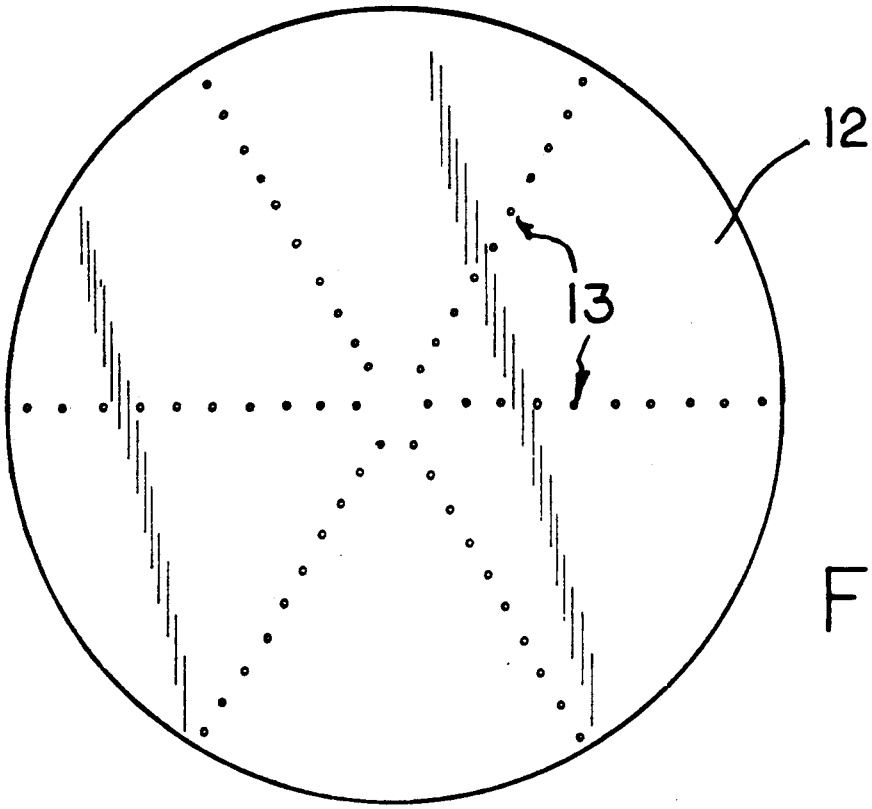
FIG. 4 is an orthographic top view of the game board.
Figure 5:
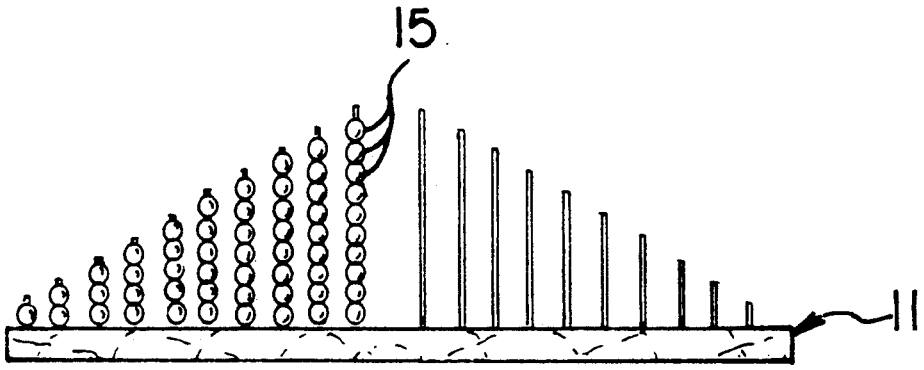
FIG. 5 is an orthographic view, taken along the lines 5—5 of FIG. 1 in the direction indicated by the arrows.

With reference now to the drawings, and in particular to FIGS. 1 to 9 thereof, a new and improved game apparatus embodying the principles and concepts of the present invention and generally designated by the reference numerals 11–29 will be described.

More specifically, the game apparatus of the invention essentially comprises a support plate 11 having a planar plate top surface 12. Plural rows of rigid rods 13 are mounted to the support plate 11 integrally oriented relative to the top surface 12 in radially directed rows. The rows each extend from the periphery 14 of the support plate 11 interiorly thereof to the axis of the support plate 11 in ascending order of height. Each player is awarded a quantity of torroidal beads 15, each typically of a contrasting coloration to permit ease of visual distinguishing of the beads of each respective player as the game apparatus accommodates two to six players, with a player being afforded one of the rows of rods 13. A dice set 16 of five six-sided dice is provided to direct play of the game.

In play, the object of the game is for a winner to be declared by being first to fill up all pegs of an associated row of a single row 13 of the pegs. Typically, ten pegs are utilized. In rolling of the dice to initiate play, a player must obtain at least one pair to begin. If one pair is not obtained, a player must wait until a subsequent turn. The players take their turns in sequence and a player to go first may be declared by various means, such as picking coins, arbitrarily designating a first player and the like.

When a player obtains a pair, that player may position one game piece upon one of the pegs that is closest to the periphery 14 of the support plate 11. Upon a subsequent turn, a player may upon obtaining a pair may throw the remaining three dice to an attempt to obtain more pair. In this manner, the players are directed to sequentially fill up the rigid rods of each row from the periphery towards the center of the plate until all of the rods are filled.

When a player rolls a pair of sixes, that player may position a game piece anywhere, even upon an opposing player's peg. When a game piece is positioned upon an opposing player's peg, that game piece or bead 15 prevents that player receiving the foreign bead from filling up anymore rods until that player rolls a pair of sixes. In this manner, the first player to fully fill the pegs is declared a winner.

Figure 6:
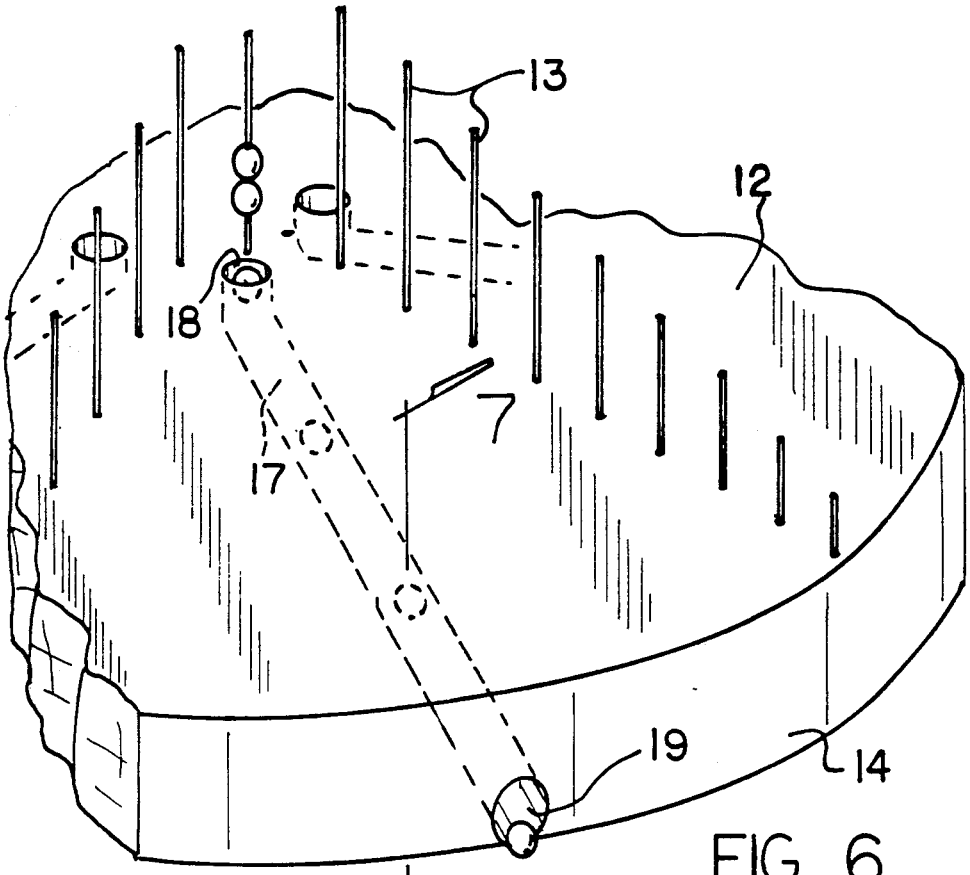
FIG. 6 is an isometric illustration of a modified game board structure.
Figure 7:
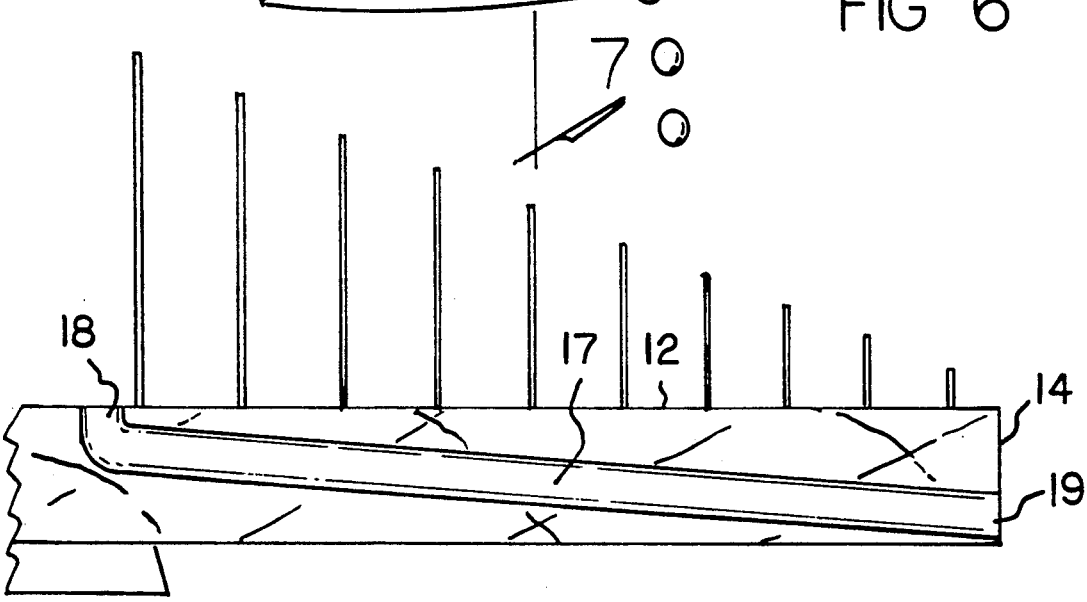
FIG. 7 is an orthographic view, taken along the lines 7—7 of FIG. 6 in the direction indicated by the arrows.

The invention as illustrated in the FIG. 6 is provided with a return conduit 17, wherein a plurality of such return conduits may be provided to return the beads 15 to each player. The conduit is directed through the support plate, with a return conduit entrance 18 projecting through the top surface 12 and the return conduit exit 19 directed through the periphery 14.

Figure 8:
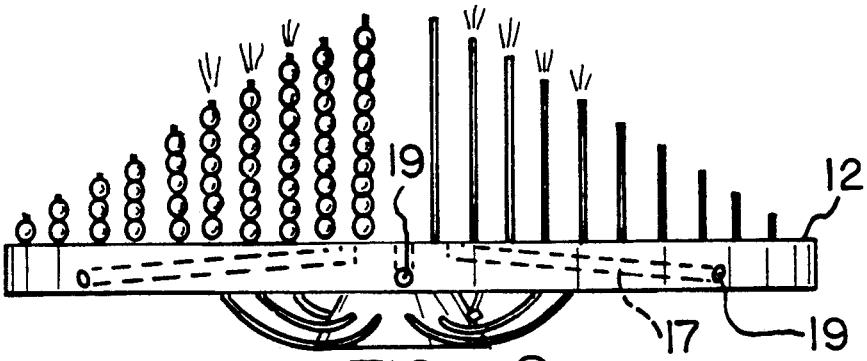
FIG. 8 is an orthographic side view of the modified game board utilizing illumination components.
Figure 9:
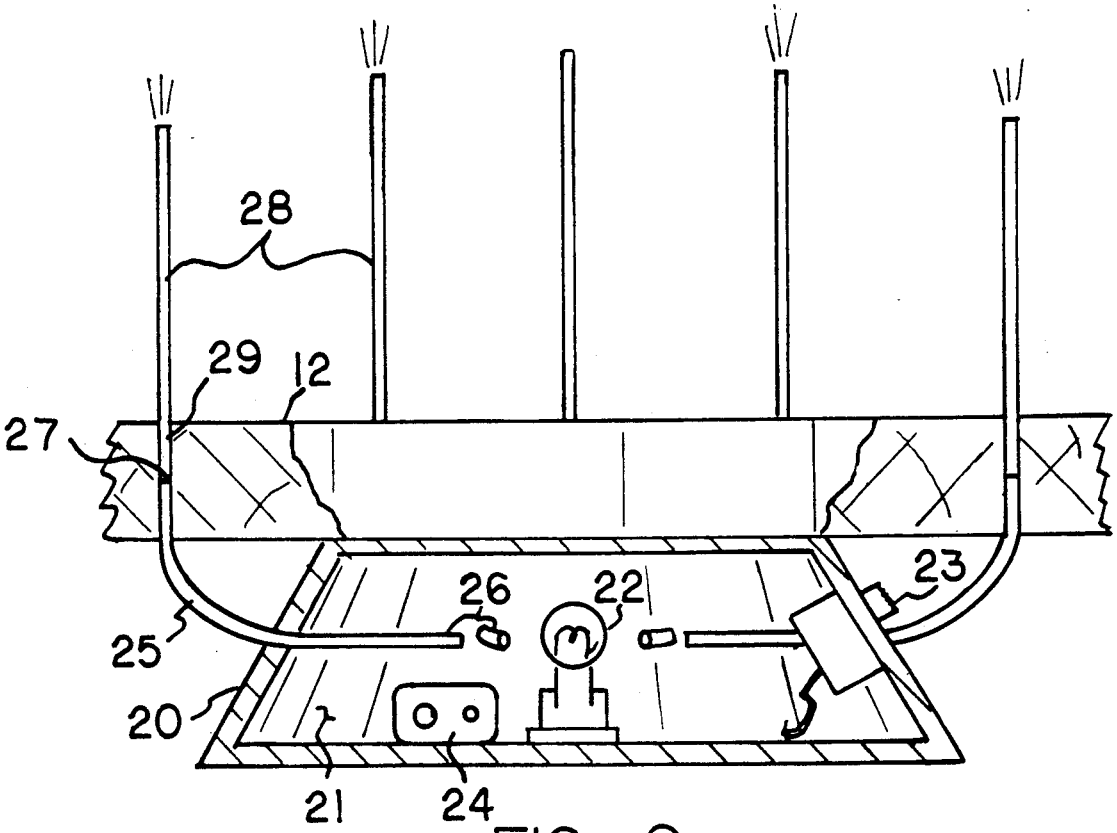
FIG. 9 is an orthographic side view, partially in section, of the game board structure as set forth in FIG. 8.

The FIGS. 8 and 9 further illustrate the use of the support plate and an associated base 20 having a base cavity 21 therewithin. The base cavity includes an illumination bulb 22 having a switch operative through a battery 24 to effect selective illumination of the illumination bulb 22. First fiber optic cables 25 are mounted within the base and have a first fiber optic cable rear distal end 26 positioned in adjacency relative to the illumination bulb 22, with the first fiber optic cable forward distal end 27 projecting into the plate below the top surface 12. A second fiber optic cable 28 is provided of rigid construction having a lower distal end, with the second fiber optic cable lower distal end slidably received within a second fiber optic cable bore coaxially aligned with the first fiber optic cable forward distal end 27. In this manner, the second fiber optic cable is removable when desired to direct the beads through the return conduit structure 17 and when positioned in their respective bores are illuminated. In this manner, positioning of the rows is cognizant to individuals playing in limited available light. The dice members 16 are formed of a self-luminescent material as required. Further, in use of the structure as set forth in FIGS. 8 and 9, termination of the game is indicated upon a row of the rods defined by the second fiber optic cables 29 being removed extinguishing illumination through the second fiber optic cable indicating termination of game play and a winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A game apparatus, comprising, a support plate, the support plate having a plate top surface, with the top surface including plural rows of rigid rods, each row of said plural rows of rigid rods includes ascending rigid rods directed from a periphery of the support plate towards an axial center thereof, and plural sets of beads, with the beads being adapted for selective mounting upon the rigid rods, and a dice set for directing a predetermined quantity of beads to be directed upon each of the rigid rods during play.

2. An apparatus as set forth in claim 1 wherein at least one return conduit is directed through the support plate, the return conduit having a return conduit entrance opening directed through the support plate top surface adjacent the axial center of the support plate, and a return conduit exit in communication with the return conduit entrance projecting through the periphery of the support plate.

3. An apparatus as set forth in claim 2 including a return conduit arranged adjacent each row of rigid rods of said plural row of rigid rods.

4. An apparatus as set forth in claim 3 including a support base, the support base having a base cavity therewithin, with the base mounted integrally and below the support plate coaxially thereof, and an illumination bulb positioned within the support base, and a switch mounted to the support base, and a battery, the switch effecting selective electrical communication of the illumination bulb with the battery to direct selective illumination of the illumination bulb, and a plurality of first fiber optic cables directed into the support base, wherein the plural rows of rigid rods define a predetermined number, and the first fiber optic cables define a further number equal to the predetermined number, and each of said first fiber optic cables is directed from the base, with a first fiber optic cable rear distal end positioned adjacent the illumination bulb, and a first fiber optic cable forward distal end directed into the support plate below the top surface below an innermost rigid rod of each row of rigid rods adjacent the axial center, with each first fiber optic cable forward distal end positioned at a lowermost end of a second fiber optic cable bore, with the second fiber optic cable bore receiving said innermost rigid rod, wherein the second rigid rod is formed as a fiber optic cable having its lower terminal end positioned in abutment with the first fiber optic cable forward distal end.

* * * * *